United States Patent [19]

Baker

[11] Patent Number: 4,909,662

[45] Date of Patent: Mar. 20, 1990

[54] ROADWAY AND METHOD OF CONSTRUCTION

[76] Inventor: Robert L. Baker, 1193 - 190th Ave., Morley, Mich. 49336

[21] Appl. No.: 296,694

[22] Filed: Jan. 13, 1989

[51] Int. Cl.[4] ..... E01C 3/00

[52] U.S. Cl. ..... 404/31; 404/28; 404/79; 264/31

[58] Field of Search ..... 404/27, 28, 31, 70, 404/82

[56] References Cited

U.S. PATENT DOCUMENTS

| | | | |
|---|---|---|---|
| 618,956 | 2/1899 | Johnson . | |
| 1,705,068 | 3/1929 | Sadtler . | |
| 2,078,485 | 4/1937 | Dunham | 94/8 |
| 2,166,033 | 5/1938 | Malone | 94/4 |
| 2,259,374 | 10/1941 | Gramelspacher | 94/4 |
| 2,358,023 | 9/1944 | Munters | 94/3 |
| 2,737,092 | 3/1956 | Gramelspacher | 94/4 |
| 3,085,482 | 4/1963 | Yakubik | 94/3 |
| 3,237,537 | 3/1966 | Hutchings | 404/70 |
| 3,500,728 | 3/1970 | Longini et al. | 94/10 |
| 3,577,894 | 5/1971 | Emerson, Jr. et al. | 94/7 |
| 3,892,826 | 7/1975 | Yost | 264/308 |
| 3,909,143 | 9/1975 | Cushman | 404/27 |
| 3,909,144 | 9/1975 | Garn et al. | 404/31 |
| 3,922,832 | 10/1975 | Dicker | 52/173 |
| 4,054,395 | 10/1977 | Kozlov et al. | 404/49 |
| 4,118,137 | 10/1978 | LaGrone et al. | 404/76 |
| 4,457,682 | 7/1984 | Nash et al. | 425/62 |
| 4,477,533 | 10/1984 | Phillips | 428/458 |
| 4,485,137 | 11/1984 | White | 428/402 |
| 4,611,015 | 9/1986 | Hefner, Jr. et al. | 524/514 |
| 4,653,956 | 3/1987 | Lang | 404/28 |
| 4,671,413 | 6/1987 | Peterson | 264/31 |

*Primary Examiner*—Bruce M. Kisliuk
*Assistant Examiner*—Gay Ann Spahn
*Attorney, Agent, or Firm*—Lon H. Romanski

[57] ABSTRACT

A roadway is shown as being formed of various strata or layers starting with a lowermost bed layer or stratum of compacted earth carrying a layer or stratum of compacted dry concrete mix; a layer of moisture impervious material covers the top of the stratum of dry concrete mix; a roadway pavement of wet concrete mix is carried atop the moisture impervious material; and air passages are formed through the roadway pavement as to be situated transversely thereof.

23 Claims, 4 Drawing Sheets

ROADWAY AND METHOD OF CONSTRUCTION

FIELD OF THE INVENTION

This invention relates generally to roadways and more particularly to roadways for use as vehicular highways.

BACKGROUND OF THE INVENTION

Generally, pavements and bases for highways may be divided into the broad classifications of "flexible" and "rigid". The term "rigid" is usually applied to those structures or constructions which consist of Portland cement concrete, in that the concrete possesses considerable flexural strength which enables it to act as a beam.

The term "flexible" as applied to a pavement structure embraces substantially all other types which include as primary components a wearing surface layer, a base layer and a subgrade layer. With this type of a pavement structure, distortions occurring in the subgrade or base layers are reflected in each of the other layers and the tendency is for all layers of the structure to conform to the same shape under loading.

With either type of roadway, the subgrade and base are of fundamental importance in the construction of adequate roadways since they support the pavement load and the prior art has made efforts to overcome defects associated therewith. Primary among the problems of roadways are those associated with frosting and pumping with pumping being of particular importance in connection with concrete pavement roadways.

Frost action results in very severe damage to bases and subgrades of both the rigid and flexible type of pavements and is occasioned by the existence of freezing temperatures in those areas. In many instances the pore water of the base or subgrade is supplemented, after freezing, by the attraction thereto of additional water through means of capillary forces as well as seepage, and the resulting expansion in volume upon complete freezing of the water induces a severe roadway upheaval. Prior art preventive measures for this destructive action have, among other things, included the removal of soils which are particularly subject to frost action and the replacement thereof with granular materials to the frost line depth or greater. Such prior art attempts have been found to be costly and frequently ineffective especially in the presence of relatively shallow water tables.

Pumping and/or subgrade failure is evidenced in connection with concrete pavements by spalling primarily at joints in turn resulting in the ejection from the joints and formed cracks of water, subgrade soil and mud, and ultimately complete breaking of the roadway structure takes place. The formation of cracks in the pavement also permits seepage of surface waters to the subgrade resulting in the further erosion thereof and finally deteriorating the subgrade to the point where it is incapable of sustaining the required traffic loads, thereby causing further breaking-up of the roadway and/or pavement. The prior art has attempted to inhibit such subgrade deterioration, resulting in the breaking-up of the roadway pavement, trying to seal all cracks as they occur and, in the case of severe deterioration, to drill holes in the road and thereafter force suitable materials in slurry form through the holes to the subgrade in order to fill the openings between the subgrade and pavement bottom. This constant maintenance problem is highly undesirable and wasteful in that it only prolongs for a short period the time within which the roadway must be completely replaced.

The prior art, as shown by U.S. Pat. No. 2,737,092, has also attempted to overcome such roadway problems by providing plywood encased or embedded in rubber and placing such as to be sandwiched directly between the bottom side of the concrete pavement and the top side of the supporting earth subgrade as well as placing such as to be sandwiched directly between the respective sides of the concrete pavement and the respective juxtaposed sides of the earth adjacent the concrete pavement. By expanding upper disposed portions of the rubber, it was hoped that moisture would not enter as between the concrete pavement and the adjacent rubber-encased plywood. Such, as well as other prior art attempts to solve the problems of weather-induced roadway deterioration have not proven to be either successful or acceptable.

The invention as herein disclosed and described is primarily directed to the minimization if not solution of the aforestated as well as other related and attendant problems of the prior art roadway structures.

SUMMARY OF THE INVENTION

According to one aspect of the invention, a roadway comprises a plurality of vertically arranged strata and layers of cooperating materials, wherein a first stratum comprises a lowermost situated first bed layer of earth, wherein a second stratum comprises a second layer of compacted dry concrete mix with such being supported by said first layer, wherein a third stratum comprises a third layer of moisture impervious sheet-like means supported by said second layer of compacted dry concrete mix, wherein a fourth stratum comprises a fourth layer of cured concrete serving as a roadway pavement, and further comprising passage means formed above said moisture impervious sheet-like means and extending transversely of the longitudinal direction of said roadway pavement and for the full width of said roadway pavement.

According to another aspect of the invention, a method of constructing a roadway comprises the steps of forming a first lowermost situated bed layer of earth and compacting the upper portion of said bed layer of earth, mixing dry portland cement with aggregate to thereby form a dry concrete mix, forming a second layer of said dry concrete mix as to be supported by said first layer of compacted earth, compacting the said second layer of said dry concrete mix, covering said compacted second layer of dry concrete mix with moisture impervious covering means, placing conduit defining forms atop said impervious covering means as to have said conduit defining forms extending generally transversely of said compacted second layer of dry concrete mix, mixing portland cement with aggregate and water to thereby form a wet concrete mix, forming a third layer of said wet concrete mix atop said impervious covering and against said conduit defining forms, and permitting said third layer of wet concrete mix to cure.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figure 1:
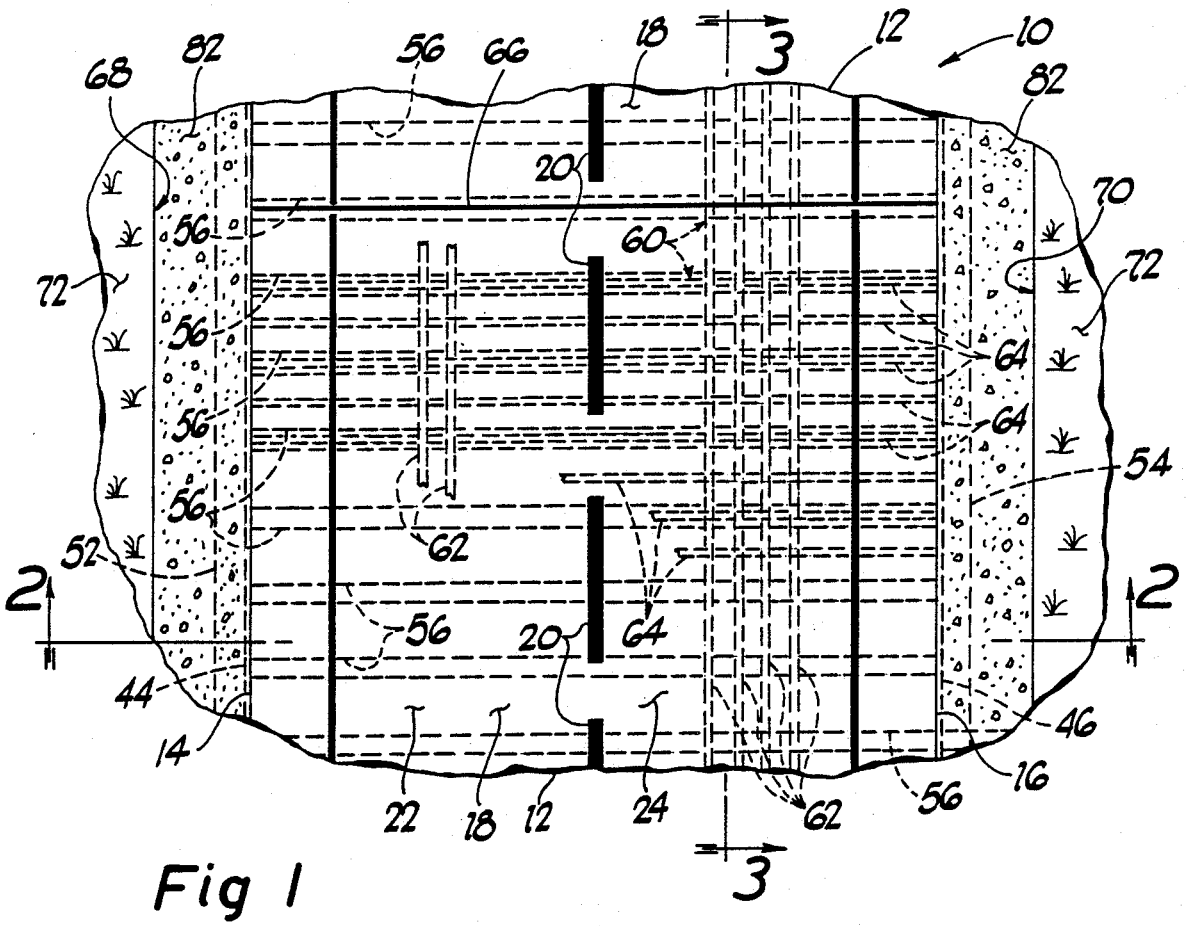
FIG. 1 is a top plan view of a fragmentary portion of a roadway employing teachings of the invention.
Figure 4:
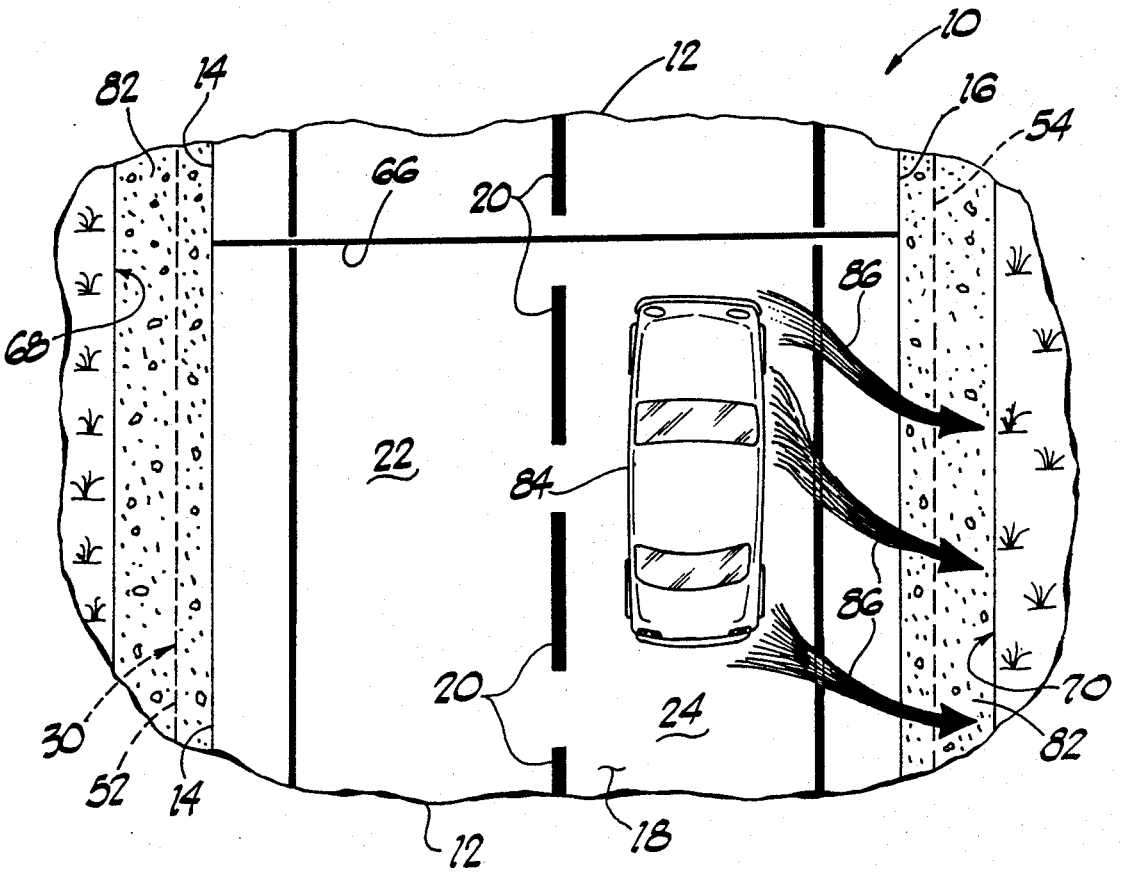
FIG. 4, similar to FIG. 1, is a top plan view of a fragmentary portion of a roadway employing teachings of the invention and further illustrating an automobile traveling along one of the traffic lanes thereof.

Referring in greater detail to the drawings, and in particular to FIGS. 1 and 4, a roadway 10 is illustrated as comprising a concrete roadway pavement 12 having opposite side edges or surfaces 14 and 16 and a top or uppermost surface 18 which may be provided as with suitable means, for example a painted segmented line 20, along the middle thereof as to establish traffic lanes 22 and 24 to the left and right, respectively, of median line 20.

Figure 2:
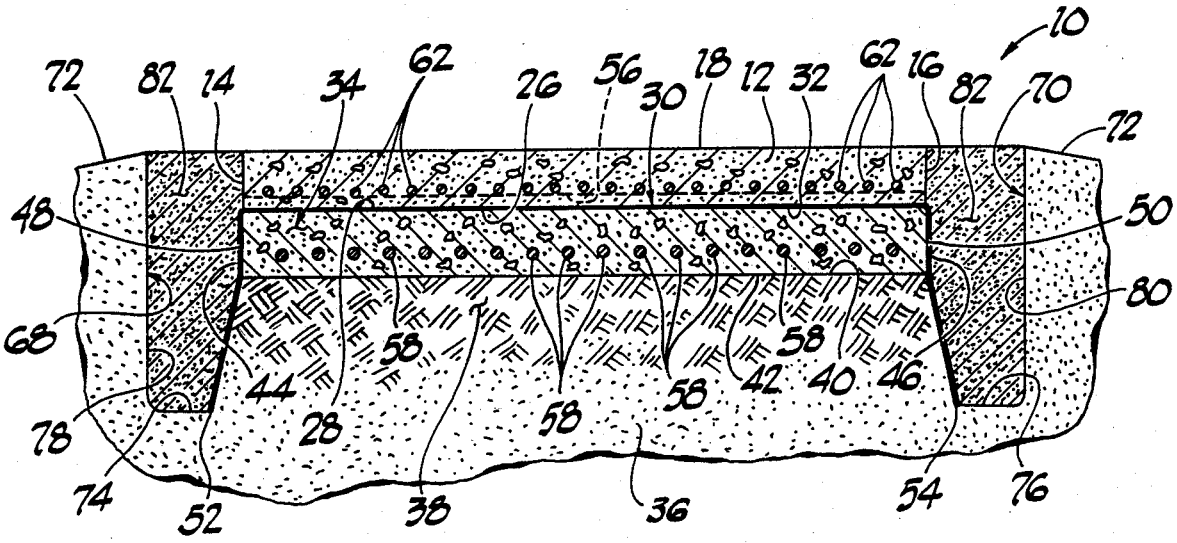
FIG. 2 is a fragmentary cross-sectional view taken generally on the plane of line 2—2 of FIG. 1 and looking in the direction of the arrows.
Figure 3:
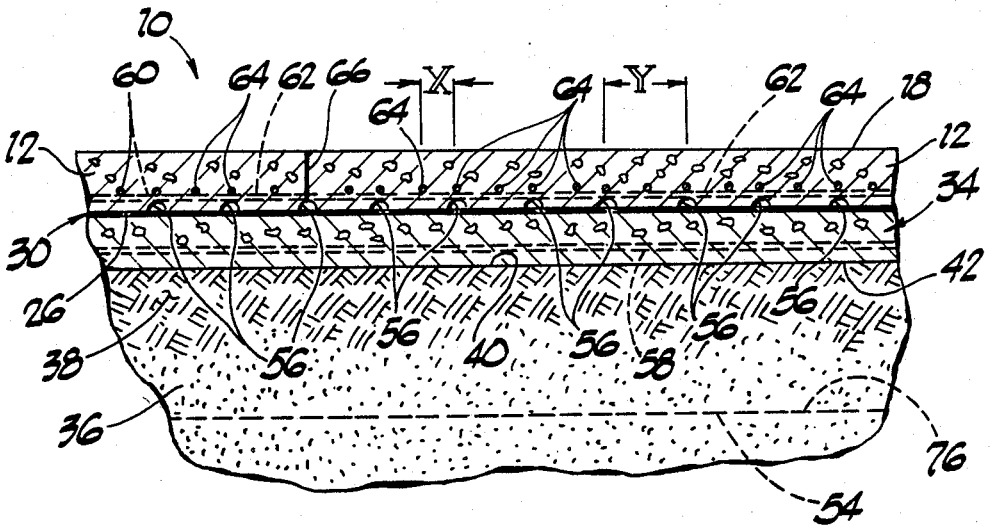
FIG. 3 is a fragmentary cross-sectional view taken generally on the plane of line 3—3 of FIG. 1 and looking in the direction of the arrows.

As best illustrated in FIGS. 2 and 3, the bottom or underside 26 of the concrete roadway pavement 12 rests against and atop the upper or top surface 28 of moisture impervious membrane-like means 30 while the lower or underside surface 32 of the moisture impervious means 30 rests against and atop a layer or stratum of dry concrete mix 34. Below the layer of dry concrete mix 34 is a supporting bed of earth 36, as for example ambient, which is compacted at the generally upper portion thereof to form a relatively compacted stratum or layer 38 which defines an upper surface 40 effectively juxtaposed to and supporting the layer or stratum 34 as by a lower disposed surface 42 thereof.

As best seen in FIG. 2, in the preferred embodiment the moisture impervious cover or membrane-like means 30 extends downwardly along both sides as to have side portions 44 and 46 thereof respectively against sides 48 and 50 of layer or stratum of dry concrete mix 34. Further, in the preferred embodiment, the side portions 44 and 46 of the moisture impervious member or means 30 extend downwardly for a substantial distance and are flared outwardly, as generally depicted in FIG. 2, as to respectively terminate at 52 and 54. Although the practice of the invention is not so limited, nevertheless, in the preferred embodiment the ends 52 and 54 of the moisture impervious means 30 may extend downwardly as to be at a distance, below the level of surface 40, in the order of 2.0 feet.

As shown in FIGS. 1, 2 and 3, a plurality of passages or conduits 56 are formed transversely of and in the roadway 10. In the preferred embodiment such passages 56 are formed generally above the moisture impervious means 30 and generally in the concrete forming the roadway pavement 12 and have their respective opposite ends open. Although the invention is not so limited, in the preferred embodiment the cross-sectional configuration of such passages 56 would be semi-circular with a radius in the order of 1.5 inches and the passages 56 would be formed as to be spaced from each other, on center, in the order of 12.0 inches. The spacing of passages 56 is depicted by the dimension, Y, in FIG. 3.

Referring to FIGS. 1, 2 and 3, in the preferred embodiment the layer or stratum of dry concrete mix 34 is provided with a plurality of reinforcing means which may take the form of a plurality of steel rods 58 spaced from each other and extending longitudinally of the roadway 10 and the stratum or layer of dry concrete mix 34. Similarly, in the preferred embodiment reinforcing means is provided within the concrete roadway pavement 12. More particularly such reinforcing means may take the form of steel rods formed into what may be termed a fencing or grid configuration wherein a first plurality of spaced longitudinally extending steel rods, which may be in the order of ten gauge, are situated generally normal to a second plurality of spaced longitudinally extending steel rods. Such crossed or crossing rods may be operatively secured to each other as by tying pairs of crossing rods to each other with strands of wire, welding pairs of crossing rods to each other or even weaving the pairs of crossing rods. Such reinforcing means are depicted at 60 of FIG. 1 and fragmentarily illustrated as comprising a first plurality of spaced rods 62, extending generally longitudinally of the roadway 10 and roadway pavement 12, and a second cooperating plurality of longitudinally extending spaced rods 64 extending transversely of roadway 10 and roadway pavement 12. In the preferred embodiment of the reinforcing means rods 62 would be spaced at about 6.0 inches, on center, from each other and rods 64 would also be spaced at about 6.0 inches, on center, from each other. Such distance of rods 64 is depicted by the dimension, X, of FIG. 3.

As a consequence of the preferred spacing (Y) of passages 56 and the preferred spacing (X) of transverse rods 64 it then becomes possible to achieve a further preferred arrangement or relationship which is the placement of the reinforcing means 60 in such a manner that alternate transverse rods 64 are situated above respective ones of the transverse passages 56 as depicted in both FIGS. 1 and 3.

FIGS. 1, 3 and 4 also illustrate the preferred manner of including and placing expansion joints in the overall roadway 10. More particularly, a suitable expansion joint, as depicted in heavy black line 66, is situated as to be above a passage 56. Many forms of expansion joints are well known in the art and the practice of the invention is not limited to the use of any particular expansion joint. The number of such expansion joints 66 and the spacing therebetween is of course dependent upon what would be considered good practice for the particular composition and depth of the roadway pavement 12 as well as the particular geographical area in which such roadway 10 were being constructed.

In the preferred embodiment of the roadway 10, it is also contemplated that trenches 68 and 70 would be formed at and along opposite sides of the principal portion of the roadway 10 as generally depicted in FIGS. 1 and 2. In such an embodiment the trenches 68 and 70 may be formed, as from the upper surface 72 of the ambient earth 36, downwardly as to lowermost respective surfaces 74 and 76 which, in turn, may be at the same depth at which edges or ends 52 and 54 of moisture impervious means 30 are situated. Further, in the preferred form of such embodiment, the side walls 78 and 80 of trenches 68 and 70, respectively, are formed as to be spaced, as from sides 14 and 16 of roadway pavement 12, in the order of two feet. The trenches 68 and 70, in turn, would be filled with a gravel and preferably loose stones 82 of a size in the order of ⅝ inch.

The invention as thus far described would, among other things, provide at least the following benefits. The compacted earth 38 would provide a bed-like supporting surface 40 which would be at an elevation substantially below the surface 72 of the earth 36 and thereby at least significantly immune to any frost induced upheaval. The layer or stratum of dry concrete mix 34 situated above and carried by the compacted portion 38 of the earth 36 will draw moisture from the earthen bed 38 thereby further reducing the moisture content of the earthen road bed which, in turn, further reduces the possibility of any upheaval in the earthen road bed resulting from the otherwise existing moisture in such earthen road bed. The lower portion of the dry concrete mix 34, upon drawing moisture from the earthen road bed, will slowly undergo a degree of hardening because of the interaction and reaction between the moisture thusly drawn and the dry cement within the dry concrete mix 34. Once the lowermost portion of the stratum or layer of dry concrete mix 34 thusly undergoes some degree of hardening, thereafter only the vapor, of any limited amount of moisture as may migrate to the compacted portion 38, will pass through such lower hardened portion of the dry concrete mix 34. Further, the rate of flow of any such moisture vapor will be very slow since no pressure differential, other than the vapor pressure itself, exists for urging flow of moisture vapor upwardly through the relatively hardened lower portion of the stratum 34 of dry concrete mix. Consequently, at least the upper portion of the stratum of dry concrete mix remains effectively dry and thereby continues to exhibit a degree of flexibility, without deleterious upheaval, as to accommodate for any possible movement as may be required by the roadway pavement 12 during its useful life.

The moisture impervious cover or membrane-like means 30 serves to cover the top surface 28 and side surfaces 48 and 50 of the layer or stratum of dry concrete mix 34 as to thereby prevent moisture from flowing onto and into the stratum 34. By having the sides 44 and 46 of the moisture impervious means 30 extending substantially downwardly to levels as generally depicted in and described with reference to FIG. 2, serves to further direct any moisture in the area away from the compacted portion 38 of the lowermost road bed as well as the earth directly below such compacted portion 38.

The transverse passages 56 provide a plurality of further benefits. As is generally well recognized, a concrete pavement (or any other form of roadway pavement), if it is to crack, will crack at its weakest area. Therefore, if during use the roadway pavement 12 were to experience a crack, such as may be occasioned as by an over-loaded vehicle, the crack would most likely occur in the roadway pavement generally immediately above a passageway 56 since the cross-sectional thickness of the roadway pavement 12 would be less in such vicinity or location. If, subsequently to the occurrence of such a crack, moisture as from rain or melting snow were to enter the crack it would not result in further damage to the roadway pavement 12 even if freezing were to occur. This is because the moisture entering the assumed crack would flow downwardly through such crack and enter the conduit or passageway 56 situated below the crack. Air flowing through the passages 56 as well as through such passage 56 as had received the moisture from the crack, would carry the free moisture out of the open ends of that passage 56. Further, in the event that freezing were to occur before all the moisture was air-flow-driven out of the passage 56, any freezing and attendant expansion of moisture within the passage 56 would not result in any damage to the roadway pavement 12 because of the relatively small amount of moisture within the passage 56 compared to the relatively large cross-sectional area of the passage 56 providing for freezing expansion of any such moisture way beyond its frozen-state volume.

Further, in the same regard and for the same purpose and with the same result, the expansion joint, typically depicted at 66 of FIG. 3, is preferably situated above a related or associated conduit or passage 56. That is, any moisture passing through the expansion joint 66, or as between the joint 66 and juxtaposed surfaces of the adjacent sections of the roadway pavement 12, would flow downwardly into the associated conduit or passage 56 and undergo the same results as hereinbefore described with reference to the assumed occurrence of a crack in the pavement 12.

Still further, as generally depicted in FIGS. 1 and 2, the open opposite ends of conduits, channels or passages 56 are in respective communication with trenches 68 and 70, and the fill contained therein, thereby resulting in additional benefits. For example, moisture which may be received in passages 56 can easily flow into the trenches 68 and 70 and since the trenches are preferably filled with loose stone, the moisture flows against the surfaces of such stone thereby enhancing the rapidity with which the moisture is evaporated to the ambient atmosphere. Further, the stone fill within the trenches does not prevent air flow through the passages 56 which, in turn, serves to sweep away any moisture as may be within passages 56. Additionally, having the passages 56 at an elevation lower than the top of the fill 82 of trenches 68 and 70 results in a somewhat chimney effect further enhancing the flow of air through the passages 56.

Since the trenches 68 and 70 are filled with loose stone, or relatively large gravel, 82 a considerable amount of free space, in the form of voids, exists in the trenches 68 and 70 among the stone 82 fill therein. This, in turn, provides for the circulation of air among the stones comprising the fill with the resulting effect that evaporation of moisture within the trenches takes place. Such air circulation, and consequent evaporation, is enhanced by atmospheric breezes and winds and is also enhanced by the air flows, near ground level, caused by vehicles traveling along the roadway pavement 12. Such vehicular created wind or air flow is depicted in FIG. 4 wherein a vehicle 84 is shown as traveling along traffic lane 24 and causing generally laterally directed air flow, as represented by arrows 86, to pass over the top of the trench 70 and the stone fill 82 contained therein.

Figure 5:
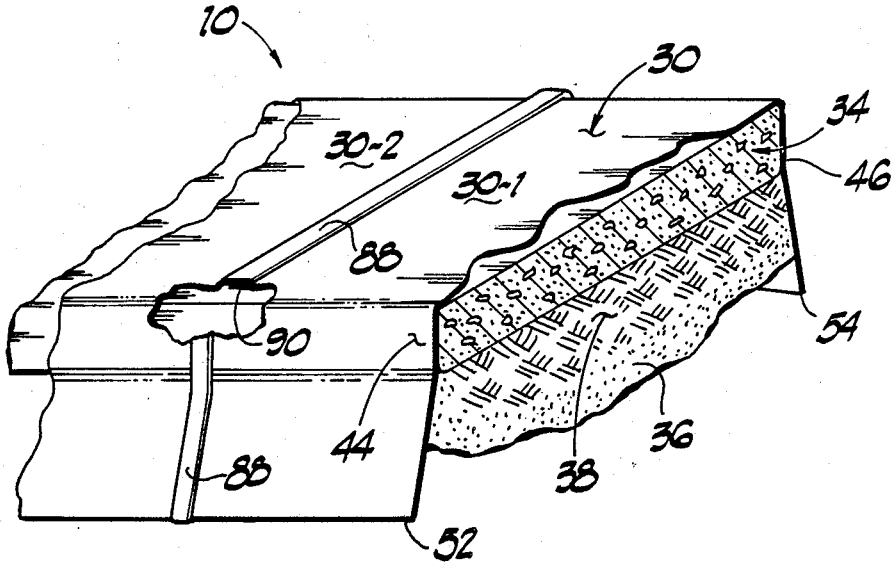
FIG. 5 is a fragmentary portion of the roadway of FIG. 1, with certain of the elements which are shown in FIG. 1 being eliminated for clarity, shown in generally isometric projection.

FIG. 5 illustrates, in somewhat simplified form, one manner of forming and applying the moisture impervious cover means of membrane means 30. As illustrated, the entire roadway membrane means 30 may be formed from a series of sections or portions of such moisture impervious material and, for purposes of illustration, 30-1 and 30-2 are intended to represent such respective sections which adjoin each other and are operatively connected to each other. As depicted sections 30-1 and 30-2 may be connected and secured to each other as by having an end portion 88 of section 30-2 overlap an adjoining end portion 90 of section 30-1 and cemented to each other, in such a configuration, as by any suitable moisture proof cementing or adhesive means. As should be apparent, in view of FIG. 5, the respective adjoining end portions of sections 30-1 and 30-2 could also be brought into a generally end-to-end abutting relationship and then the seam therebetween effectively covered by a strip of like or suitable material which, in turn, would likewise be cemented to both sections 30-1 and 30-2.

In the preferred embodiment, the moisture impervious cover means or membrane means would be comprised of 0.045 inch thick sheet-like material in turn comprised of ethylene propylene diene terpolymer (EPDM) which is an elastomer based on stereospecific linear terpolymers of ethylene, propylene and small amounts of diene; e.g., a cyclic or aliphatic diene (hexadiene, dicyclopentadiene, or ethylidene norbornene). The saturated part of the polymer molecule is pendant from the main chain, which is completely saturated.

The preferred method of constructing the roadway 10 would be as follows. Referring to FIGS. 1, 2, 3, 5 and 6, a lowermost bed or stratum of preferably ambient earth 36 would be formed and graded and the upper portion thereof would be compacted as to form an upper disposed layer or stratum 38 comprised of compacted earth material. Then a first layer of dry concrete mix would be applied to the upper surface 40 of the compacted portion 38 of earth material and such first layer of dry concrete mix would be compacted as to form a compacted layer of such dry concrete mix of a vertical thickness in the order of about 3.0 inches. The reinforcing means, as longitudinally extending rods 58——58, would then be laid atop the compacted 3.0 inch thick layer or stratum of dry concrete mix and, thereafter additional quantities of dry concrete mix would be placed over the reinforcing means 58——58, and compacted, until an additional layer of compacted dry concrete mix of a vertical thickness in the order of about 5.0 inches was attained. This, of course, would result in an overall compacted dry concrete mix 34 having a vertical thickness in the order of about 8.0 inches with the reinforcing means 58—58 being embedded therein. In the preferred embodiment of the invention, the dry concrete mix would be comprised of the following constituents per cubic yard of such resulting dry concrete mix: (a) 658 pounds of portland cement; (b) 820 pounds of aggregate of 1.0 inch maximum size; (c) 820 pounds of aggregate of ⅜ inch maximum size and (d) 1,640 pounds of sand. Variations of such mixtures are of course possible.

Following the formation of the stratum or layer of dry concrete mix 34, the moisture impervious covering means 30 is laid atop the stratum of dry concrete mix 34 and downwardly along the sides 48 and 50 thereof to a depth in excess of the thickness of the dry concrete mix 34. This, of course, keeps all moisture which may appear above and to the sides of the dry concrete mix 34 from entering such stratum 34.

Figure 6:
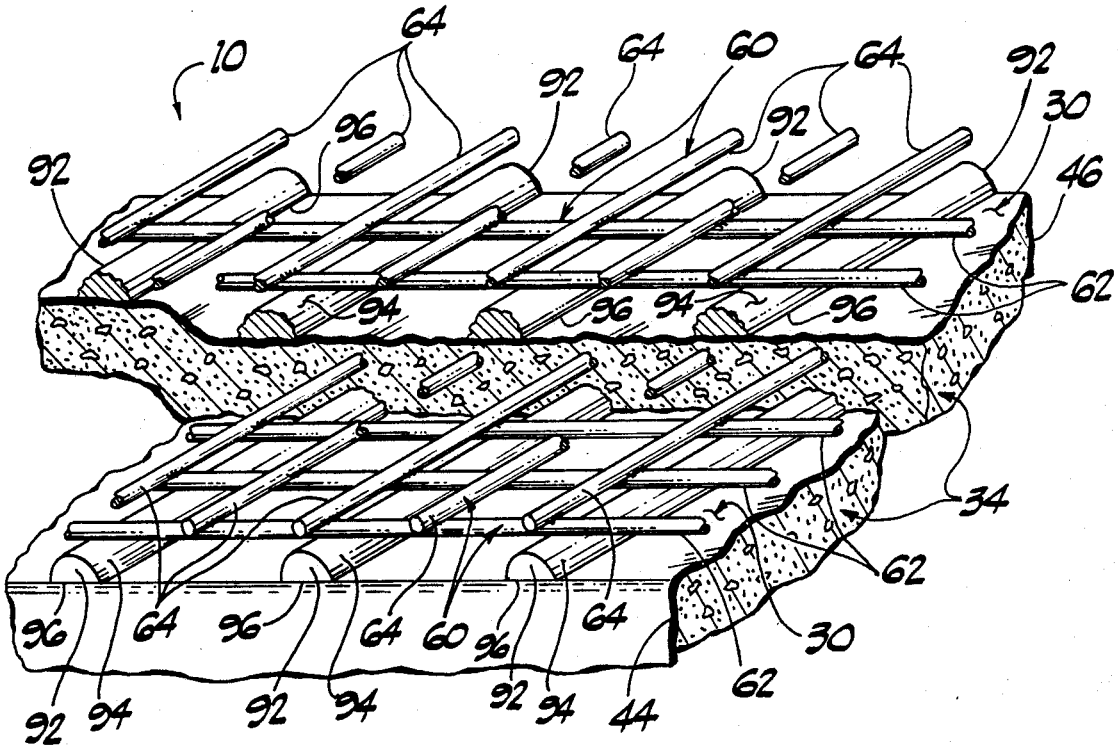
FIG. 6 is a fragmentary portion of the roadway of FIG. 1, with certain of the elements which are shown in FIG. 1 being eliminated for clarity, shown in generally isometric projection with portions thereof broken away and in cross-section and further illustrating the employment of elements not shown in FIG. 1 but employable in the construction of the roadway of FIG. 1.

Before pouring the wet concrete mix to form the roadway pavement 12, the preferred method of construction employs mold-like means for forming or defining the air passage means 56—56. FIG. 6, in somewhat simplified form illustrates the preferred method.

Referring in greater detail to FIG. 6, a plurality of mold-like or insert members 92—92 are illustrated as being respectively placed atop the moisture impervious means 30 as to extend fully transversely of the longitudinal extension of the roadway 10. In the preferred configuration, such insert members would be longitudinally extending having an outer and upper disposed half-cylindrical surface 94 and a diametrical flat lower surface 96. Preferably such inserts or members 92 would be spaced from each other as to correspond to the desired spacing of the air passages 56 as previously described as with reference to FIGS. 1 and 3. Further, to better assure that the members 92, once placed atop the cover means 30, would not be unintentionally moved during subsequent construction operations, in the preferred method suitable adhesive means would be employed as between the flatted surfaces 96—96 and the juxtaposed surface portions of the cover means 30 to thereby stabilize the locations and positions of insert members 92. Although the invention is not so limited, in the preferred embodiment, the insert members 92, in transverse cross-section, would have a radius in the order of about 1.5 inches thereby having each projecting about 1.5 inches above the top surface 28 of moisture impervious means 30 and a base surface 96 of about 3.0 inches wide in transverse cross-section.

Once the desired number of such insert members 92 are properly placed atop impervious cover means 30, the reinforcing means 60 may be placed directly atop the members 92 thereby further assuring the continued desired location of members 92 and, at the same time, keeping the entire reinforcing means 60 spaced about 1.5 inches above the top surface 28 of moisture impervious means 30. In the preferred method, the reinforcing means 60 would be so placed atop insert members 92 as to result in at least alternate transverse rods 64 to be disposed generally above an associated insert member 92.

After the insert members 92 and the reinforcing means 60 are thusly placed and located, the wet concrete mix is poured over both thereby filling all space between and above the insert members 92 as well as filling all the space below, above, and around the bars or rods 62 and 64 of which the reinforcing means 60 may be comprised. The pouring of such wet concrete mix continues until a concrete stratum defining the roadway pavement 12 is attained. Even though the thickness of the stratum of pavement 12 may vary from case-to-case as to meet the anticipated requirements of the particular roadway under construction, it is anticipated that in probably most situations a total vertical thickness of the concrete pavement 12 in the order of about 8.0 inches would be sufficient. Assuming that such total thickness, as measured from the top surface 28 of impervious cover means 30 to the roadway or pavement surface 18 were to be 8.0 inches and further assuming that the insert members 92 projected 1.5 inches upwardly from surface 28 of cover means 30, then the effective thickness of the roadway pavement 12, immediately above respective insert members 92, would be 6.5 inches thereby, as previously discussed, serving to localize where cracks will occur in the roadway pavement 12 of such is exposed to, for example, overloaded vehicles or other unanticipated magnitudes of stress. Once the roadway pavement 12 is permitted to sufficiently cure, it is of course immediately useful for its intended purpose.

Although the types and relative percentages of ingredients may vary depending upon, for example, the intended load carrying capability of the roadway 10, it is anticipated that the wet concrete mix for the roadway pavement 12 would be comprised of, per cubic yard of wet concrete used: (a) 564 pounds of portland cement; (b) 20.0 gallons of water; (c) 1,900.0 pounds of limestone aggregate and (d) 1,300.0 pounds of sand.

In the preferred embodiment, the insert members 92 would be formed of bead foam styrofoam formulated to quickly dissipate preferably shortly after the roadway pavement 12 has cured. Such material and formulation is available, it is believed, from a number of sources one of which is Huntsman Chemical Corporation having its corporate offices at 200 Eagle Gate Tower, Salt Lake City, Utah. Once the insert members 92 thusly degrade and/or dissipate the passages 56 remain and are totally open to the flow of air therethrough.

Figure 7:
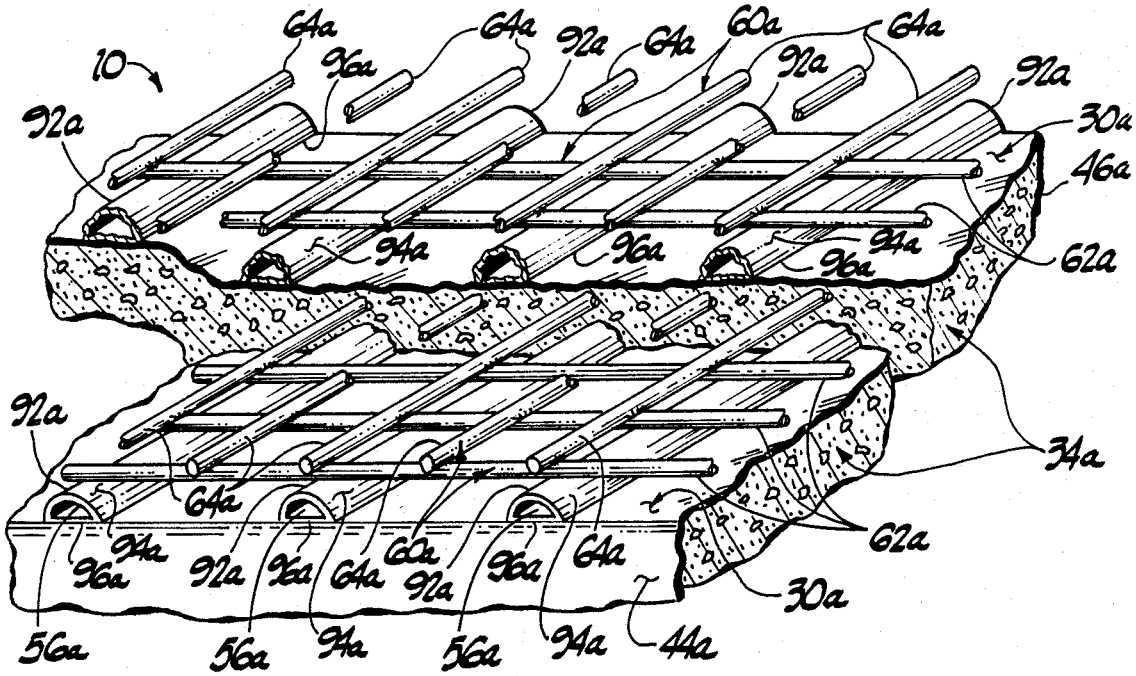
FIG. 7 is a view similar to FIG. 6 but illustrating still other elements not shown in FIG. 1 but employable in the construction of the roadway of FIG. 1.

Although not preferred, another method of forming the transversely extending air passages is also contemplated. Such employs conduit members which, in effect, take the place of the insert members 92. FIG. 7 depicts such other method.

In FIG. 7 all elements which are like or similar to those FIG. 6 are identified with like reference numbers provided with a suffix "a". Referring to FIG. 7, and comparing such to FIG. 6, it can be seen that the insert members **92*a*, which can be formed of any suitable material, have a passage extending therethrough and that such passages 56*a*, would function in the same way to provide for air flow therethrough as passages 56**.

The forming of trenches 68 and 70 is preferably done at the time that preparation of the earthen bed 36–38 is underway and such trenches 68 and 70 are preferably filled with loose stone 82 once the roadway pavement 12 has hardened.

Although only a preferred embodiment and a modification of the invention have been disclosed and described other embodiments and modifications of the invention are possible within the scope of the appended claims.

What is claimed is:

1. A roadway, comprising a plurality of vertically arranged strata and layers of cooperating materials, wherein a first stratum comprises a lowermost situated first bed layer of earth, wherein a second stratum comprises a second layer of compacted dry concrete mix with such being supported by said first layer, wherein a third stratum comprises a third layer of moisture impervious sheet-like supported by said second layer of compacted dry concrete mix, wherein a fourth stratum comprises a fourth layer of cured concrete serving as a roadway pavement having an uppermost roadway surface, and further comprising passage means for the flow of ambient air therethrough formed in said fourth layer of cured concrete and extending transversely of the longitudinal direction of said roadway pavement and for the full width of said roadway pavement, and wherein said passage means is formed in said fourth layer of cured concrete as to have a lowermost portion of said passage means above said moisture impervious sheet-like means and as to have an uppermost portion of said passage means in said cured concrete of said fourth layer and at an elevation below said roadway surface.

2. A roadway according to claim 1, wherein said moisture impervious sheet-like means extends over and against the top of said second layer of compacted dry concrete mix and extends downwardly as to cover opposite sides of said second layer of compacted dry concrete mix.

3. A roadway according to claim 1 and further comprising structural reinforcing means embedded in said second layer of compacted dry concrete mix.

4. A roadway according to claim 1 and further comprising structural reinforcing means embedded in said second layer of compacted dry concrete mix, and wherein said reinforcing means comprises a plurality of longitudinally extending rod members.

5. A roadway according to claim 1 and further comprising structural reinforcing means embedded in said fourth layer of cured concrete roadway pavement.

6. A roadway according to claim 1 and further comprising first structural reinforcing means embedded in said second layer of compacted dry concrete mix, and second structural reinforcing means embedded in said fourth layer of cured concrete roadway pavement.

7. A roadway according to claim 5 wherein said passage means is situated at an elevation as to have said lowermost portion of said passage means above said moisture impervious sheet-like means and as to have said uppermost portion of said passage means below said structural reinforcing means.

8. A roadway according to claim 7 wherein said passage means comprises a plurality of passages spaced from each other.

9. A roadway according to claim 7 wherein said passage means comprises a plurality of passages spaced from each other, wherein said structural reinforcing means comprises reinforcing portions extending generally transversely of said roadway pavement, and wherein at least certain of said reinforcing portions are situated elevationally generally above certain of said plurality of passages.

10. A roadway according to claim 7 wherein said passage means comprises a plurality of passages spaced from each other, wherein said structural reinforcing means comprises a plurality of spaced first rod members extending generally transversely of said roadway pavement, wherein said structural reinforcing means comprises a plurality of spaced second rod members extending generally longitudinally along the longitudinal extent of said roadway pavement, and wherein at least certain of said plurality of passages are situated generally below certain of said first rod members.

11. A roadway according to claim 1 and further comprising first and second trenches- respectively formed along opposite sides of said roadway pavement, wherein said first and second trenches contain loose aggregate as to thereby provide voids and spaces between portions of said aggregate, and wherein said passage means communicates with said voids and spaces.

12. A roadway according to claim 1 wherein said third layer of moisture impervious sheet-like means extends over and against the top of said second layer of compacted dry concrete mix and extends downwardly as to cover opposite sides of said second layer of compacted dry concrete mix and at least a portion of said bed layer of earth.

13. A roadway according to claim 12 wherein said layer of moisture impervious sheet-like means flares generally outwardly at least near the lower portions thereof which extend downwardly from the top of said second layer of compacted dry concrete.

14. A roadway according to claim 1 and further comprising first structural reinforcing means embedded in said second layer of compacted dry concrete mix, second structural reinforcing means embedded in said fourth layer of cured concrete roadway pavement, wherein said passage means comprises a plurality of passages spaced from each other, wherein said second structural reinforcing means comprises a plurality of spaced first rod members extending generally transversely of said roadway pavement, wherein said second structural reinforcing means comprises a plurality of spaced second rod members extending generally longitudinally along the longitudinal extent of said roadway pavement, wherein at least certain of said plurality of passages are situated generally below certain of said first rod members, and wherein said third layer of moisture impervious sheet-like means extends over and against the top of said second layer of compacted dry concrete mix and extends downwardly as to cover opposite sides of said second layer of compacted dry concrete mix and at least a portion of said bed layer of earth.

15. A method of constructing a roadway, comprising the steps of forming a first lowermost situated bed layer of earth, compacting the upper portion of said bed layer of earth, mixing dry portland cement with aggregate to thereby form a dry concrete mix, forming a second layer of said dry concrete mix to be supported by said bed layer of compacted earth, compacting said second layer of said dry concrete mix, covering said compacted second layer of dry concrete mix with moisture impervious covering means, placing conduit defining forms atop said impervious covering means as to have said conduit defining forms extending generally transversely of said compacted second layer of dry concrete mix, mixing portland cement with aggregate and water to thereby form a wet concrete mix, forming a third layer of said wet concrete mix atop said impervious covering means and against and atop said conduit defining forms, and permitting said third layer of wet concrete mix to cure.

16. A method of constructing a roadway according to claim 15 wherein the step of forming said second layer of said dry concrete mix comprises the step of imbedding structural reinforcing means in said dry concrete mix.

17. A method of constructing a roadway according to claim 15 wherein the step of forming said second layer of said dry concrete mix comprises the steps of first forming only an elevationally lower portion of said second layer of said dry concrete mix, compacting said lower portion of said second layer of said dry concrete mix, laying structural reinforcing means onto the compacted lower portion of said second layer of said dry concrete mix, then forming an elevationally higher portion of said second layer of said dry concrete mix over said structural reinforcing means and the compacted lower portion of said second layer of said dry concrete mix, and compacting said elevationally higher portion of said second layer of said dry concrete mix.

18. A method of constructing a roadway according to claim 15 and further comprising the step of placing structural reinforcing means above said conduit defining forms prior to forming said third layer of said wet concrete mix.

19. A method of constructing a roadway according to claim 18 wherein the step of placing structural reinforcing means above said conduit defining forms comprises the step of placing said structural reinforcing means directly atop said conduit defining forms as to be supported thereby.

20. A roadway according to claim 1 wherein said passage means comprises a plurality of passages spaced from each other, wherein each of said passages in transverse cross-section comprises a flow area of a configuration wherein said lowermost portion is wider than said uppermost portion.

21. A roadway according to claim 20 wherein said uppermost portion in said transverse cross-section is curvilinear in outer configuration while said lowermost portion in said transverse cross-section is generally flat.

22. A roadway according to claim 20 wherein said configuration of said flow area at least approaches that of a semicircle.

23. A roadway, comprising a plurality of vertically arranged strata and layers of cooperating materials, wherein a first stratum comprises a lowermost situated first bed layer of earth, wherein a second stratum comprises a second layer of compacted dry concrete mix with such being supported by said first layer, wherein a third stratum comprises a third layer of moisture impervious sheet-like means supported by said second layer of compacted dry concrete mix, wherein a fourth stratum comprises a fourth layer of cured concrete serving as a roadway pavement, and further comprising passage means formed above said moisture impervious sheet-like means and extending transversely of the longitudinal direction of said roadway pavement and for the full width of said roadway pavement.

* * * * *

UNITED STATES PATENT AND TRADEMARK OFFICE

CERTIFICATE OF CORRECTION

PATENT NO. : 4,909,662

DATED : March 20, 1990

INVENTOR(S) : Robert L. Baker

It is certified that error appears in the above-identified patent and that said Letters Patent is hereby corrected as shown below:

Cover page, under the heading "References Cited", U.S. Patent Document "2,166,033" should be --- 2,116,033 ---.

Column 9, line 59:

Claim 1, line 8 thereof, between "sheet-like" and "supported" insert --- means ---.

Column 11, line 36:

Claim 15, line 6 thereof, between "mix" and "to" insert --- as ---.

Signed and Sealed this

Fourteenth Day of May, 1991

*Attest:*

*Attesting Officer*

HARRY F. MANBECK, JR.

*Commissioner of Patents and Trademarks*